US006205987B1

(12) United States Patent
Shigedomi et al.

(10) Patent No.: US 6,205,987 B1
(45) Date of Patent: Mar. 27, 2001

(54) SMALL-SIZED BOAT

(75) Inventors: Hideo Shigedomi; Hiroshi Funai; Yasushi Fujita, all of Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/215,525

(22) Filed: Dec. 18, 1998

(51) Int. Cl.[7] ..... F02B 13/00
(52) U.S. Cl. ..... 123/583; 440/88
(58) Field of Search ..... 123/579, 580, 123/581, 582, 583, 584; 440/88

(56) References Cited

U.S. PATENT DOCUMENTS 2,313,258 * 3/1943 Olson ..... 123/583
3,742,922 * 7/1973 Hisatomi et al. ..... 123/579
4,532,904 * 8/1985 Osawa et al. ..... 123/580
5,517,977 * 5/1996 Nakai et al. ..... 123/580
5,676,887 * 10/1997 Soeda et al. ..... 261/35
5,718,204 * 2/1998 Sugii ..... 123/438
5,732,685 * 3/1998 Nakamura ..... 123/514
5,921,225 * 7/1999 Nakamura ..... 123/583

* cited by examiner

*Primary Examiner*—Noah P. Kamen
(74) *Attorney, Agent, or Firm*—Adams & Wilks

(57) ABSTRACT

A small-sized boat of the present invention includes a plurality of diaphragm type carburetors corresponding to each cylinder of a multicylinder engine. A crankshaft axis extends along a line extending through a bow and a stern of a hull. The carburetors include a plurality of shafts for throttle valves extending vertically in correspondence thereto, one throttle link connected to upper parts of the shafts for the throttle valves, and a plurality of diaphragm mechanisms having operating surfaces perpendicular to the crankshaft axis. By linking a plurality of the carburetors together to form an assembly of the carburetors, an overall size of carburetors is made small. Therefore, each carburetor can be mounted in a small engine room in correspondence to each cylinder of the engine.

39 Claims, 12 Drawing Sheets

SMALL-SIZED BOAT

BACKGROUND OF THE INVENTION

1. Field of the Invention

The present invention relates to an improvement in a small-sized boat thrust by a jet pump.

2. Description of the Related Art

Generally, a small-sized boat often called "Personal Watercraft" is constructed such that a jet pump disposed in an engine room of a hull is driven by a multicylinder engine to thereby thrust the boat. An example of such a small-sized boat is disclosed, for example, in Japanese Patent Laid-Open Publication No. HEI-7-237587 entitled "Water Sliding Boat" in which rotation of an impeller causes water to jet backwardly to thereby thrust the water sliding boat.

The water sliding boat includes a four-cycle two-cylinder engine within a cowling (an engine room) of a hull thereof. The engine drives the impeller. A crankshaft of the engine is disposed along a line passing through a bow and a stern of the hull. Two intake manifolds are connected to the engine such that they extend transversely of the engine. One carburetor is connected to the intake manifolds.

Generally, for improving output characteristics of a four-cycle multicylinder engine, a carburetor is preferably attached to each cylinder. Also, in order to increase a thrusting force of the impeller of the water sliding boat, it is preferable that a plurality of carburetors are connected to the four-cycle two-cylinder engine.

The cylinders have axes inclined obliquely upwardly. In a small space defined between an inner surface of the cowling and side surfaces opposite from inclined sides of the cylinders, there are disposed a carburetor and a cyclone filter. Difficulty is encountered in disposing a plurality of carburetors in such a small space. More particularly, since a float type carburetor has a float chamber, the carburetor provides limited freedom for disposition in the cowling. Further, the carburetor is made relatively large. Moreover, in the case where the float carburetor is employed, a float sways when the hull pitches and rocks. Thus, care should be taken to keep stable output characteristics of the engine.

SUMMARY OF THE INVENTION

It is therefore an object of the present invention to provide a small-sized boat which allows easy attachment of a carburetor to each cylinder of a multicylinder engine disposed in a small engine room thereof and which enables the maintenance of stable output characteristics of the engine even when a hull thereof pitches and rocks.

According to an aspect of the present invention, there is provided a small-sized boat thrust by a jet pump, which comprises: a multicylinder engine disposed in an engine room of a hull for driving the jet pump, the multicylinder engine having a crankshaft axis disposed along a line extending through a bow and a stern of the hull; a plurality of diaphragm carburetors including shafts for throttle valves each provided vertically in correspondence to the number of cylinders of the engine, one throttle link connected to upper parts of the shafts for the throttle valves, and a plurality of diaphragm mechanisms having operating surfaces perpendicular to the crankshaft axis; and a fuel supplying pipe disposed below the carburetors in parallel with the crankshaft axis.

Preferably, the plurality of diaphragm carburetors are assembled together to form a single body. In other words, the diaphragm type carburetor is smaller in size than a carburetor having a float chamber. Thus, the diaphragm carburetor can be relatively freely disposed in the engine room as compared to other carburetors having a float chamber. Such plural diaphragm carburetors may be linked together to form a single body of carburetors. In particular, the shafts for the throttle valves, the operating surfaces of the diaphragm mechanisms, and the fuel supplying pipe are reasonably disposed in the engine room. Therefore, the carburetor assembly is made small.

Consequently, it becomes possible to attach each carburetor in correspondence to each cylinder of the multicylinder engine disposed in the small engine room of the small-sized boat.

Because the carburetor assembly is made small in the manner as described above, respective intake passages of an intake manifold connected to the engine can have substantially the same configuration, whereby the amount of air introduced into each cylinder can be uniform to thereby provide an output of the multicylinder engine steadily.

Since the diaphragm type carburetor is employed in the present invention, it becomes possible to steadily control an the amount of fuel supplied to the engine even when the hull of the small-sized boat pitches and rocks, thereby attaining a steady output of the engine.

Furthermore, the carburetors of the present invention include shafts for choke valves each provided vertically and one choke link connected to upper parts of the shafts for the choke valves through levers each provided on the shaft for the choke valve.

The diaphragm mechanism may comprise a case body, a lid, a diaphragm chamber formed by the case body and the lid, a diaphragm for separating the diaphragm chamber into a reference pressure chamber and a pressure applying chamber, a swing arm pivotably mounted in the pressure applying chamber with one end thereof located centrally of the diaphragm, a compression spring for urging the one end of the swing arm toward the diaphragm, a valve body for attaching the other end of the swing arm thereto, and a valve seat opened and closed by the valve body.

BRIEF DESCRIPTION OF THE DRAWINGS

A certain preferred embodiment of the present invention will hereinafter be described in detail, by way of example only, with reference to the accompanying drawings, in which.

DETAILED DESCRIPTION OF THE PREFERRED EMBODIMENT

Figure 1:
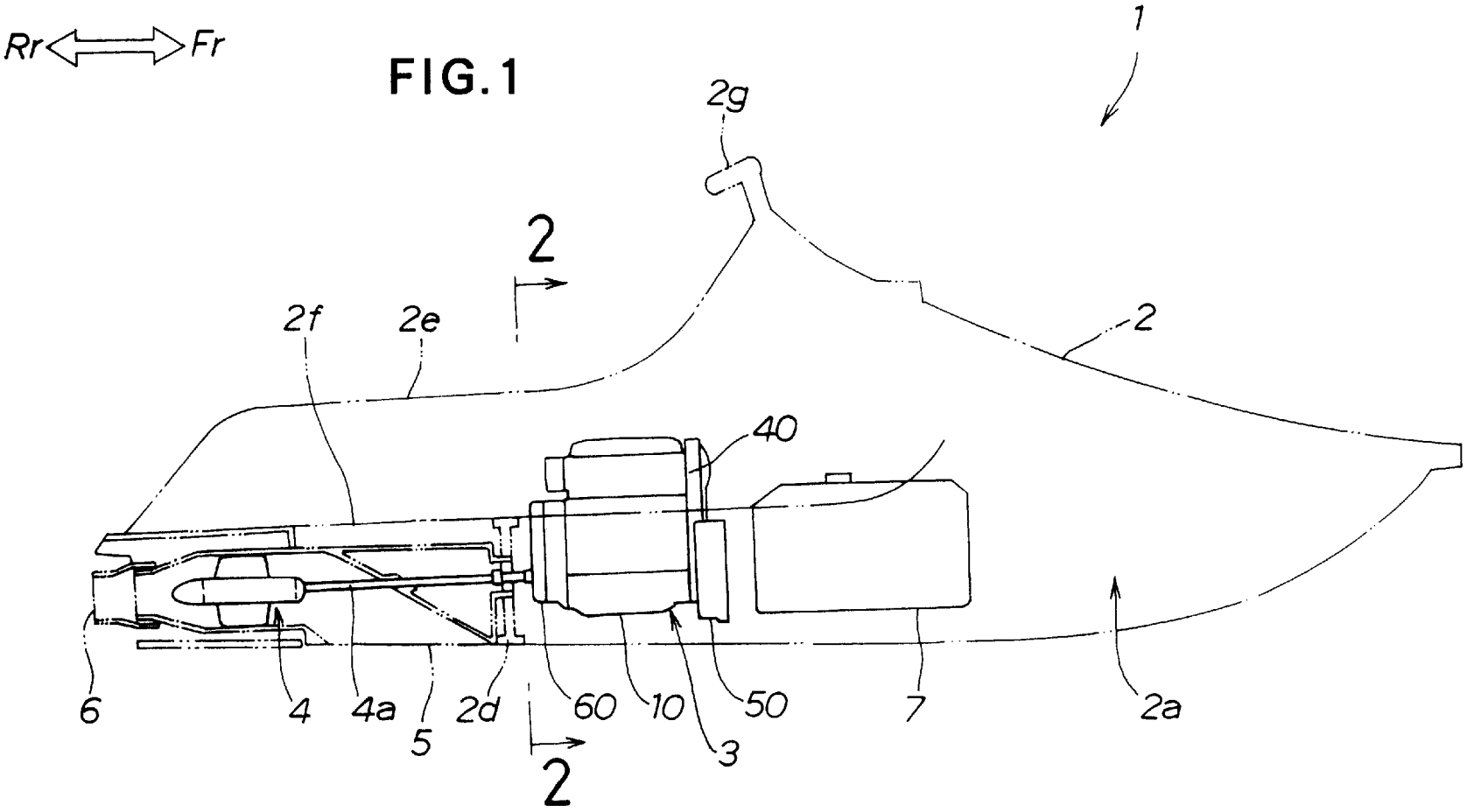
FIG. 1 is a schematic side view showing a small-sized boat according to the present invention, having a dry sump lubricating type four-cycle engine unit carried thereon.

The following description is merely exemplary in nature and is in no way intended to limit the invention or its application or uses.

Throughout the accompanying drawings, reference characters Fr, Rr denote a bow direction and a stern direction, respectively. Similarly, right and left directions of a hull as viewed from the direction Rr are designated by reference characters R and L, respectively.

As shown in FIG. 1, a small-sized boat 1 carries a dry sump lubricating four-cycle engine unit 3 thereon. The small-sized boat 1 indicated by a phantom line is used, e.g., for leisure or the like. The small-sized boat 1 includes the dry sump lubricating four-cycle engine unit (engine) 3 in an engine room or compartment 2*a* of a hull 2 thereof. The engine 3 is operated by the combustion of a fuel in a fuel tank 7 to drive a jet pump 4. The jet pump 4 pressurizes water taken into the hull 2 from a bottom portion of the hull 2 and spurts the water in jets backwardly of the hull 2. Stated otherwise, after water taken into the hull 2 from a water intake port 5 formed at the bottom portion of the hull 2 is pressurized by the jet pump 4, the water jets from a discharge nozzle 6. By thus spurting water in jets, the small-sized boat 1 is advanced.

Reference numeral 2*d* denotes a bulkhead. Designated by reference numeral 2*e* is a driver seat. A driver can rest his feet on decks 2*f* astride the seat 2*e*. Reference numeral 2g is a steering bar.

Figure 2:
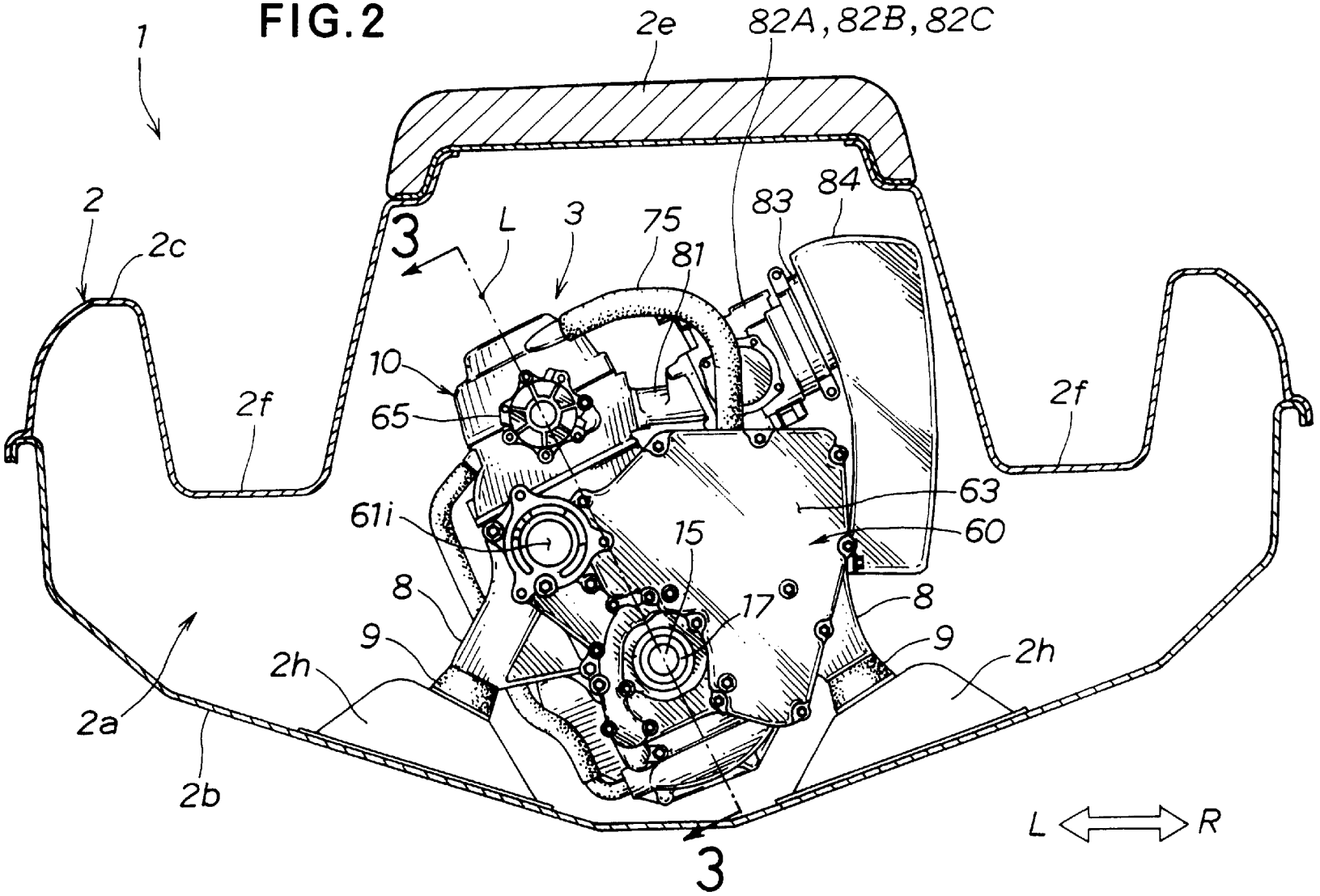
FIG. 2 is an enlarged cross-sectional view taken along line 2—2 of FIG. 1.

FIG. 2 is a cross-sectional view taken along line 2—2 of FIG. 1, showing the dry sump lubricating four-cycle engine unit 3 disposed in the engine room 2*a* (comprised of a lower hull 2*b* and an upper hull 2*c*).

For operating the dry sump lubricating system, a lubricating oil is supplied from a lubricating oil tank provided outside a halved crankcase to lubrication points of the engine unit 3. A lubricating oil unused for the lubrication is temporarily collected at a bottom portion of the halved crankcase and rapidly pumped up into the lubricating oil tank.

As shown in FIG. 2, a crankshaft 15 extends in a front-and-rear direction of the small-sized boat 1 (a direction perpendicular to this drawing sheet). A cylinder axis L extends in an upper left direction of the figure. Four (front, rear, right and left) mounts 8 (only two shown in this figure) are mounted on four mounting carriers 2h of the lower hull 2*b*. Reference numerals 9, 9 designate mount rubbers corresponding to the mounts 8 in number.

Figure 3:
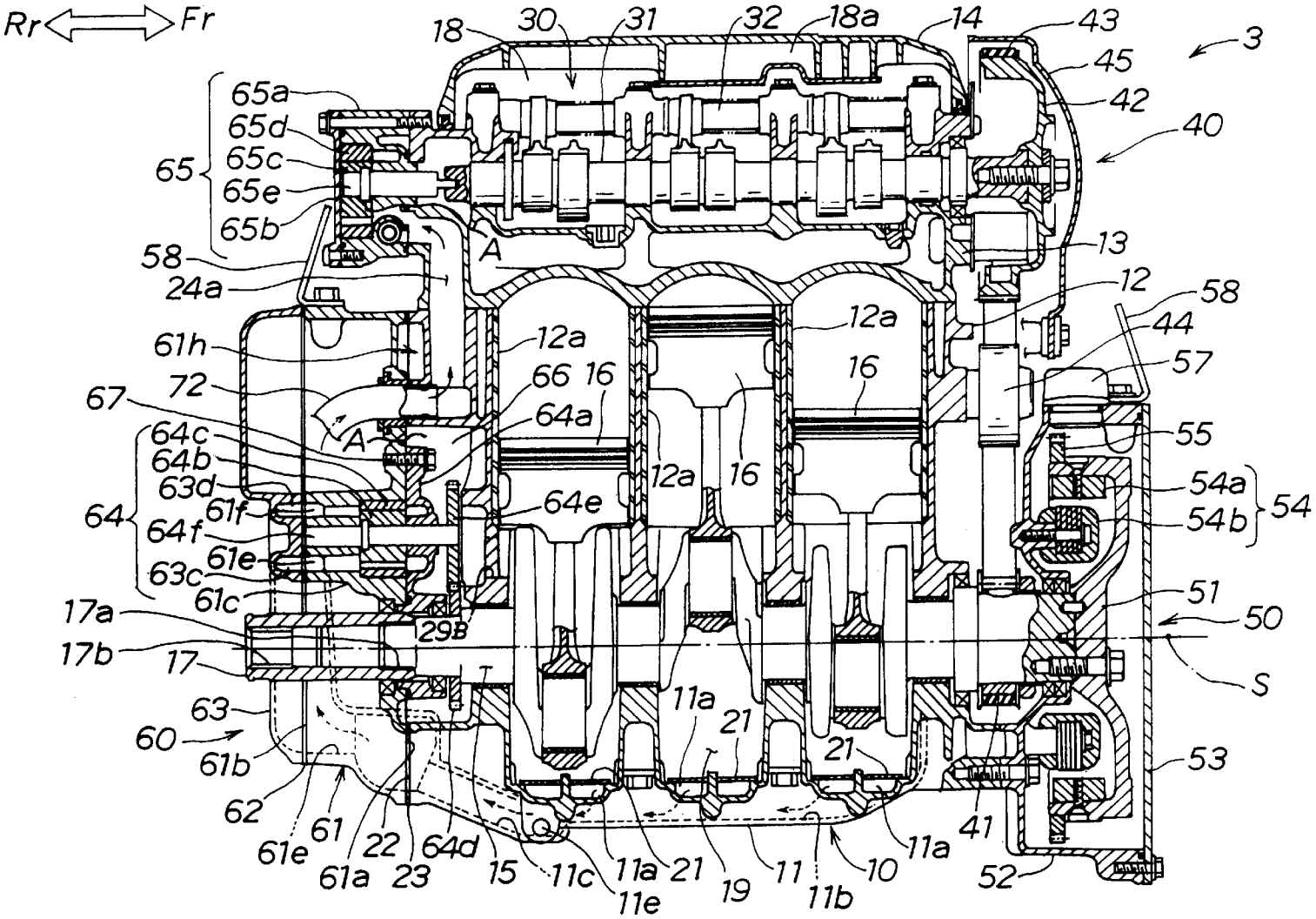
FIG. 3 is an enlarged cross-sectional view taken along line 3—3 of FIG. 2.

FIG. 3 is a cross-sectional view taken along line 3—3 of FIG. 2, showing, in section, the engine unit 3 designed to supply its motive power backwardly of the small-sized boat 1 (leftward of this figure). As shown in this figure. an axis of the crankshaft 15 (hereinafter referred to as "crankshaft axis S") is disposed along a line extending through the bow and stern of the hull 2. Namely, the crankshaft axis S extends in a bow-and-stern direction (Fr-Rr direction).

In this figure, although a passageway extending through an intake pipe 72 and an intake oil passage 24*a* (an area indicated by reference character A—A) is displaced from the line 3—3 of FIG. 2, the area is shown in section together with other members for clarity.

The engine unit 3 comprises an engine having three horizontally juxtaposed cylinders. The engine comprises an engine body 10, a valve actuating driving mechanism 40 and a flywheel unit 50, both attached to a front portion of the engine body 10, and a lubricating unit 60 attached to a rear part of the engine body 10.

The engine body 10 comprises a halved crankcase (crankcase) 11, a cylinder block 12 including three cylinders 12*a* juxtaposed in the bow-and-stern direction (Fr-Rr), a cylinder head 13, a head cover 14, the horizontally extending crankshaft 15, pistons 16 connected to the crankshaft 15 and inserted into the respective cylinders 12*a*, a PTO (power take-off) shaft 17 connected to a rear end of the crankshaft 15, a valve actuating chamber 18 jointly defined by the cylinder head 13 and the head cover 14, and a valve actuating mechanism 30 accommodated in the valve actuating chamber 18.

The PTO shaft 17 extends more backwardly than the lubricating unit 60 for connection to a drive shaft 4*a* of the jet pump 4 shown in FIG. 1. Reference numeral 17*a* denotes a connecting portion connected to the crankshaft 15 while reference numeral 17*b* designates a connecting portion for taking the motive power out of the engine unit 3. The connecting portions 17*a*, 17*b* are made of internal threads or splines.

The halved crankcase 11 includes three collecting portions 11*a* for collecting a lubricating oil which remains after lubrication of sliding parts of the engine unit 3, a guiding passage 11*b* for guiding a lubricating oil collected in the collecting portions 11*a*, and a returning oil passage 11*c* for returning a lubricating oil from the guiding passage 11*b* to the lubricating unit 60.

Each collecting portion 11*a* comprises an oil reservoir having small capacity. More specifically, the collecting portion 11*a* is disposed closely to the crankshaft 15 such that the lubricating oil accumulated therein is not in contact with a counter weight (web) of the crankshaft 15. Further, the crankshaft 15 and a surface of the lubricating oil positioned therebelow are separated from each other by a baffle plate 21.

The valve actuating driving mechanism 40 is a mechanism for driving a camshaft 31 of the valve actuating mechanism 30 by means of a belt driven by the crankshaft 15. The valve actuating driving mechanism 40 has a driving pulley 41 secured to the crankshaft 15 protruding from a front part of the halved crankcase 11, a driven pulley 42 secured to the camshaft 31 protruding from a front part of the cylinder head 13, a timing belt 43 passing over the driving and driven pulleys 41, 42, and a belt tensioner 44 for adjusting tension of the timing belt 43. Reference numeral 45 denotes a belt cover.

The flywheel unit 50 includes a flywheel 51 bolted to a front end of the crankshaft 15, a wheel case 52 bolted to a front side portion of an assembly formed by assembling the cylinder block 12 and the halved crankcase 11 together to accommodate the flywheel 51 therein, and a sheet-shaped lid 53 bolted to a free end (front end) of the wheel case 52 to cover the same.

A generator 54 has a rotor 54*a* attached to an interior peripheral surface of the flywheel 51, and a coil 54*b* mounted on the wheel case 52. There is mounted a ring gear 55 on an exterior peripheral surface of the flywheel 51. The ring gear 55 is connected to a starter motor described later. Reference numeral 57 designates a check cap which closes an opening for checking rotational angle of the crankshaft 15 by means of the flywheel 51.

The lubricating unit 60 includes a lubricating oil tank 61 bolted to a rear side portion of the assembly formed by the cylinder block 12 and the halved crankcase 11, a lid 63 for closing a free end (rear end) of the lubricating oil tank 61, a returning pump 64 for returning a lubricating oil from the collecting portion 11*a* to the lubricating oil tank 61, and a supplying pump 65 for supplying a lubricating oil from the lubricating oil tank 61 to the sliding parts of the engine body 10.

The returning pump 64 is built in the lubricating oil tank 61. The supplying pump 65 is disposed separately from the lubricating oil tank 61. A tank mounting packing surface 22 for mounting the lubricating oil tank 61 to the halved crankcase 11 is formed sidewardly (of the engine body 10) of the assembly formed by the cylinder block 12 and the halved crankcase 11. The packing surface 22 is also formed on a surface perpendicular to the crankshaft 15.

On the lubricating oil tank 61, a first packing surface 61*a* and a second packing surface 61*b* are formed in parallel with each other. That is, the lubricating oil tank 61 includes the first packing surface 61*a* and the second packing surface 61*b* spaced from each other along the crankshaft axis S. The second packing surface 61*b* is positioned behind the first packing surface 61*a*, that is, the second packing surface 61*b* is separated from the first packing surface 61*a* in a direction from the cylinder block 12 to the PTO shaft 17.

With the first packing surface 61*a* joined to the tank mounting packing surface 22 through a packing 23, the lubricating oil tank 61 is mounted to the assembly formed by assembling together the cylinder block 12 and the halved crankcase 11. The lid 63 is bolt fitted to the second packing surface 61*b* through a packing 62. Such a lubricating oil tank 61 is a sealed tank which is sealed by a side wall of the assembly and the lid 63 to accumulate the lubricating oil therein.

The returning pump 64 is a scavenging pump comprised of a case portion 61*c* formed integrally with the lubricating oil tank 61, an inner cover 64*a* for closing the case portion 61*c*, an inner rotor 64*b* accommodated within the case portion 61*c*, an outer rotor 64*c* disposed on an outer peripheral portion of the inner rotor 64*b*, and a shaft 64*f* connected to the crankshaft 15 through a driving mechanism (comprised of a driving gear 64*d* and a driven gear 64*e*) so as to drive the inner and outer rotors 64*b*, 64*c*. The driving mechanism is accommodated in a space 66 between the lubricating oil tank 61 and the assembly formed by the cylinder block 12 and the halved crankcase 11.

On a joining surface between the lubricating oil tank 61 and the lid 63, i.e., a joining surface between the second packing surface 61*b* and the lid 63, there is formed an oil passage for the returning pump 64. More specifically, an intake oil passage 61*e* and a discharging oil passage 61*f* for the returning oil passage 64 are formed in the lubricating oil tank 61. Further, in the lid 63, there is formed an intake oil passage 63*c* and a discharging oil passage 63*d* for the returning pump 64. The intake oil passage 61*e* formed in the lubricating oil tank 61 communicates with the returning oil passage 11*c* provided in the halved crankcase 11.

As is apparent from this figure, the intake oil passages 61*e*, 63*c* communicate with each other to define one intake oil passageway. Likewise, the discharging oil passages 61*f*, 63*d* communicate with each other to define one discharging oil passageway. Such intake and discharging oil passageways form an oil passageway for the returning pump 64.

The space 66 serves for one part of a breather passage for communicating the valve actuating chamber 18 and a crank chamber 19 with each other. The case portion 61*c* and the inner cover 64*a* are joined together by a bolt 67.

The supplying pump 65 includes a case body 65*a* bolted to a side portion of an assembly formed by assembling together the cylinder head 13 and the head cover 14, a cover 65*b* for closing the case body 65*a*, an inner rotor 65*c* accommodated within the case body 65*a*, an outer rotor 65*d* positioned on an outer peripheral portion of the inner rotor 65*c*, a shaft 65*e* directly connected to the camshaft 31 of the valve actuating mechanism 30 so as to drive the inner and outer rotors 65*c*, 65*d*.

The shaft 64*f* of the returning pump 64 and the shaft 65*e* of the supplying pump 65 extend in parallel with the crankshaft 15 and the camshaft 31, respectively.

Figure 6:
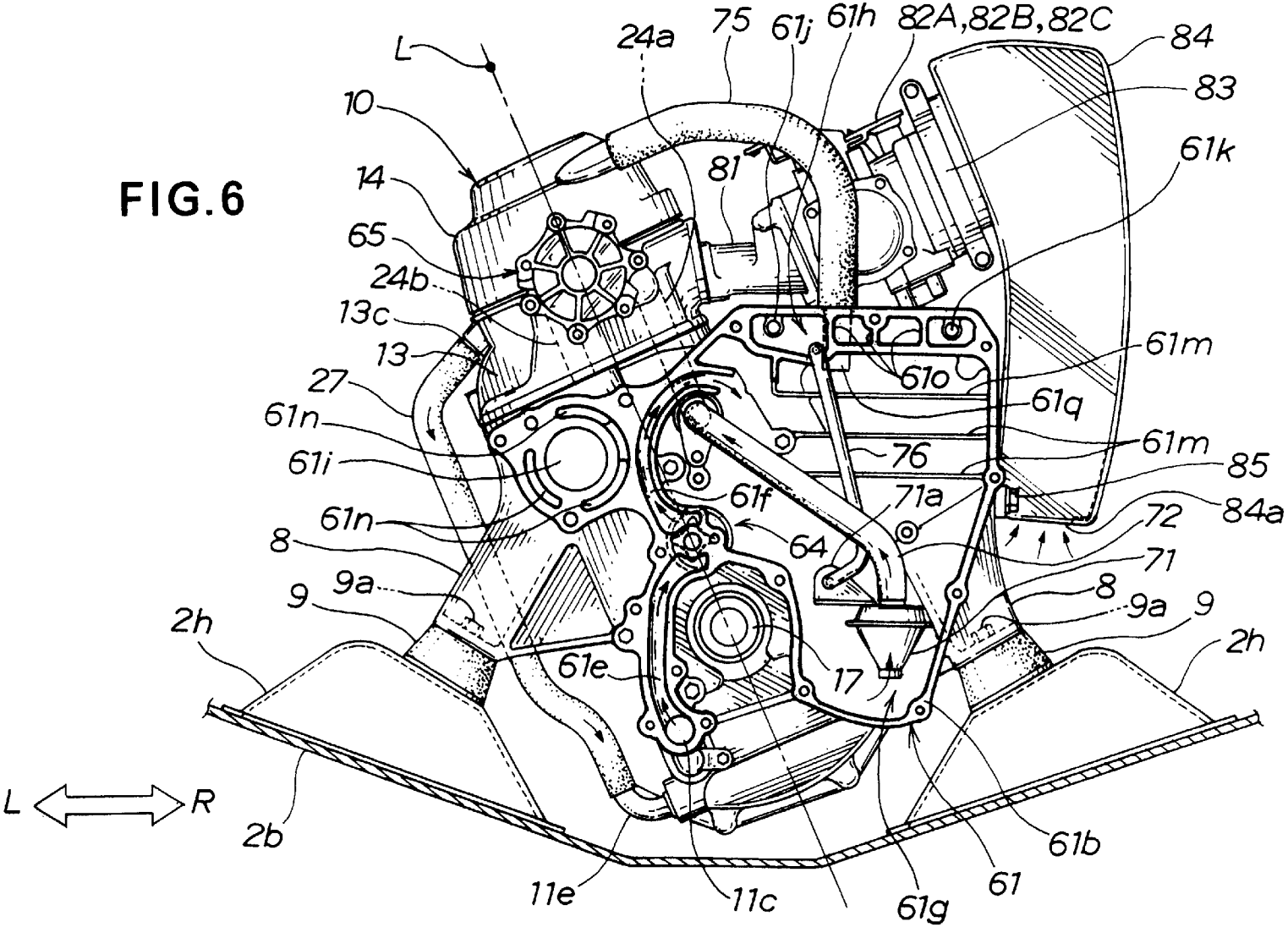
FIG. 6 shows in rear elevation the dry sump lubricating type four-cycle engine unit with a lid of the lubricating oil tank removed.

The assembly formed by the cylinder block 12 and the cylinder head 13 includes the intake oil passage 24*a* and a discharge oil passage 24*b* for the supplying pump 65 (see FIG. 6). Reference numerals 58, 58 denote hangers.

Figure 4:
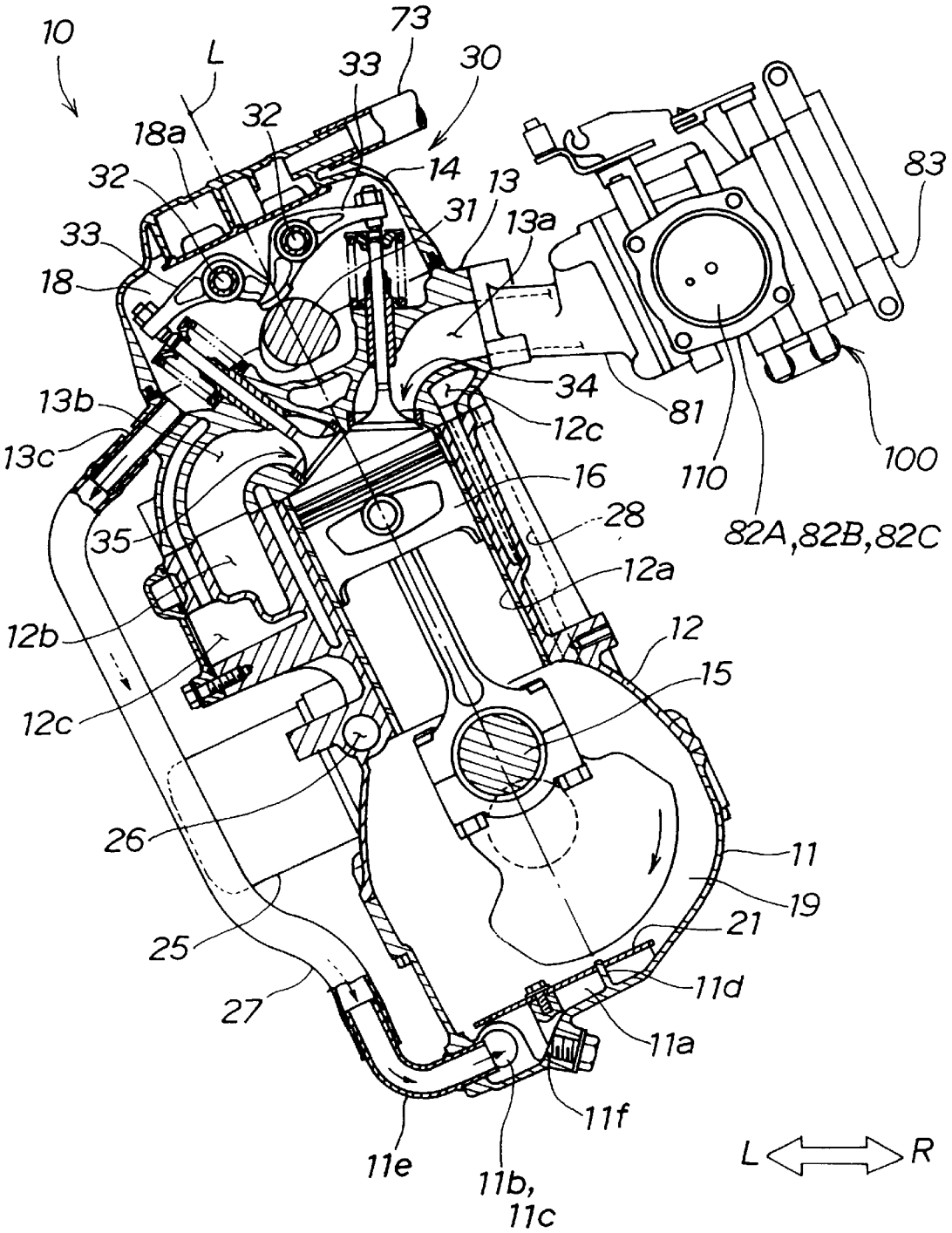
FIG. 4 is an enlarged cross-sectional view of an engine body as shown in FIG. 3.

FIG. 4 is a cross-sectional view of the engine body 10 according to the present invention, showing the engine body 10 with the cylinder axis L extending in an upper left direction of this figure.

As shown in FIG. 4, the valve actuating mechanism 30 comprises the camshaft 31, two rocker shafts 32, 32, a pair of rocker arms 33, 33 mounted on the rocker shafts 32, 32, an intake valve 34, and an exhaust valve 35.

The cylinder head 13 includes an intake passage 13*a* and an exhaust passage 13*b*. The intake passage 13*a* communicates via an intake manifold 81 with diaphragm type carburetors 82A, 82B, 82C having no floats. The exhaust passage 13*b* communicates with an exhaust passage 12*b* of the cylinder block 12.

At an upper part of the head cover 14, there is formed a blow-by gas returning first breather chamber 11*a*. The first breather chamber 18*a* is positioned at an upper part of the valve actuating chamber 18.

Each baffle plate 21 is fixed to the halved crankcase 11 and positioned below the crankshaft 15. In this preferred embodiment, the baffle plate 21 is secured to the crankcase 11 by engaging one point thereof with an engaging projection 11*d* formed at a bottom portion of the halved crankcase 11 while bolting another point thereof to the halved crankcase 11.

Reference numeral 26 denotes a supplying oil passage. The supplying oil passage 26 is connected to the supplying pump 65 (see FIG. 6) via the discharge oil passage 24*b* (see FIG. 6) and a filter 25. The supplying oil passage 26 is provided for supplying a lubricating oil to the respective sliding parts of the engine body 10.

Designated by reference numeral 27 is an oil returning tube for returning a lubricating oil from the valve actuating chamber 18 to the crank chamber 19. In this embodiment, by connecting a nozzle 13*c* of the cylinder head 13 to a nozzle 11*e* disposed at a lower half of the halved crankcase 11 by means of the oil returning tube 27, the oil returning tube 27 communicates with the collecting portion 11*a* and the guiding passage 11*b*.

The valve actuating chamber 18 and the crank chamber 19 communicate with each other through a communicating passage 28. Reference numeral 11*f* designates a drain aperture for drawing off drainage from the collecting portion 11*a*. Reference numerals 12*c*, 12*c* denote passages for cooling water.

Figure 5:
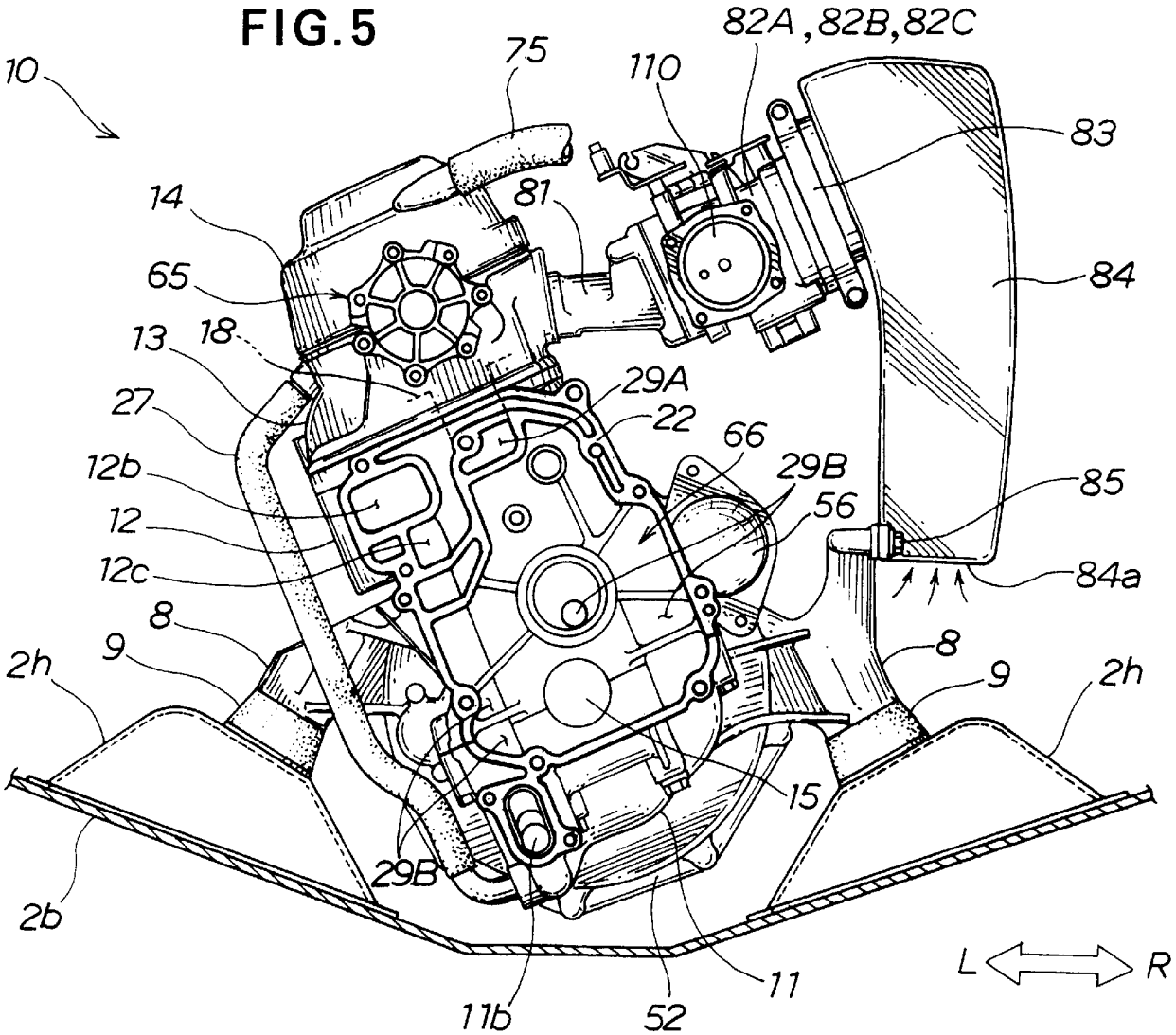
FIG. 5 shows in rear elevation the dry sump lubricating type four-cycle engine unit with a lubricating oil tank removed.

FIG. 5 shows the engine body 10 with the lubricating oil tank of the dry sump lubricating type four-cycle engine unit removed therefrom. As can be seen from this figure, the tank mounting packing surface 22 of the assembly formed by the cylinder block 12 and the halved crankcase 11 is opened.

A plurality of breather passages 29A, 29B communicate the valve actuating chamber 18 and the crankcase 19 (see FIG. 3) with each other via a space (the space 66 shown in FIG. 3) closed by the tank mounting packing surface 22. In other words, the breather passage 29A and the breather passage 29B communicate with each other through the space.

The starter motor 56 starts the engine 3 by turning the flywheel 51 through the ring gear 55 of the flywheel unit 50.

By connecting an induction box 84 to the carburetors 82A, 82B, 82C by means of a communicating tube 83, there is formed an intake line for the engine body 10 comprised of the intake manifold 81, the carburetors 82A, 82B, 82C and the induction box 84. The induction box 84 has an intake port 84*a* at a lower portion thereof and is mounted to the mount 8 by a bolt 85.

FIG. 6 illustrates the second packing surface 61*b* of the lubricating oil tank 61 opened by removing the lid for the lubricating oil tank of the dry sump lubricating system four-cycle engine unit.

The lubricating oil tank 61 includes an oil accumulating portion 61g, which is continuous to a projecting portion 61*d* (see FIG. 7), for accumulating lubricating oil, a second breather chamber 61h at a higher level than the oil accumulating portion 61g, and an engine exhaust port 61i for the engine, all of which are formed integrally with each other. The engine exhaust port 61i communicates with the exhaust passage 12*b* as shown in FIG. 4 with exhaust pipes provided outside the engine body 10.

The intake oil passage 61*e* is separated from the oil accumulating portion 619 with the PTO shaft 17 disposed therebetween. The returning pump 64 and the supplying pump 65 are located at positions through which the cylinder axis L extends. The returning pump 64 is positioned above the PTO shaft 17. The supplying pump 65 is positioned above the returning pump 64.

The intake pipe 72 with a strainer 71 for the supplying pump 65 is accommodated in the oil accumulating portion 61g with an upper end thereof communicating with the intake oil passage 24*a* for the supplying pump 65 (see FIG. 3).

The mounts 8 are attached to the mount rubbers 9 through bolts 9*a*. Within the oil accumulating portion 61g, three-fold baffle walls 61m for preventing the scatter of oil are vertically provided. By means of cooling water ports 61n, the passages 12*c*, 12*c* as shown in FIG. 5 communicate with pipes for cooling water provided outside the engine body 10. A third breather tube 75 communicates via a gas port 61q with the lubricating oil tank 61 and communicates with the valve actuating chamber 18 (see FIG. 3).

Figure 7:
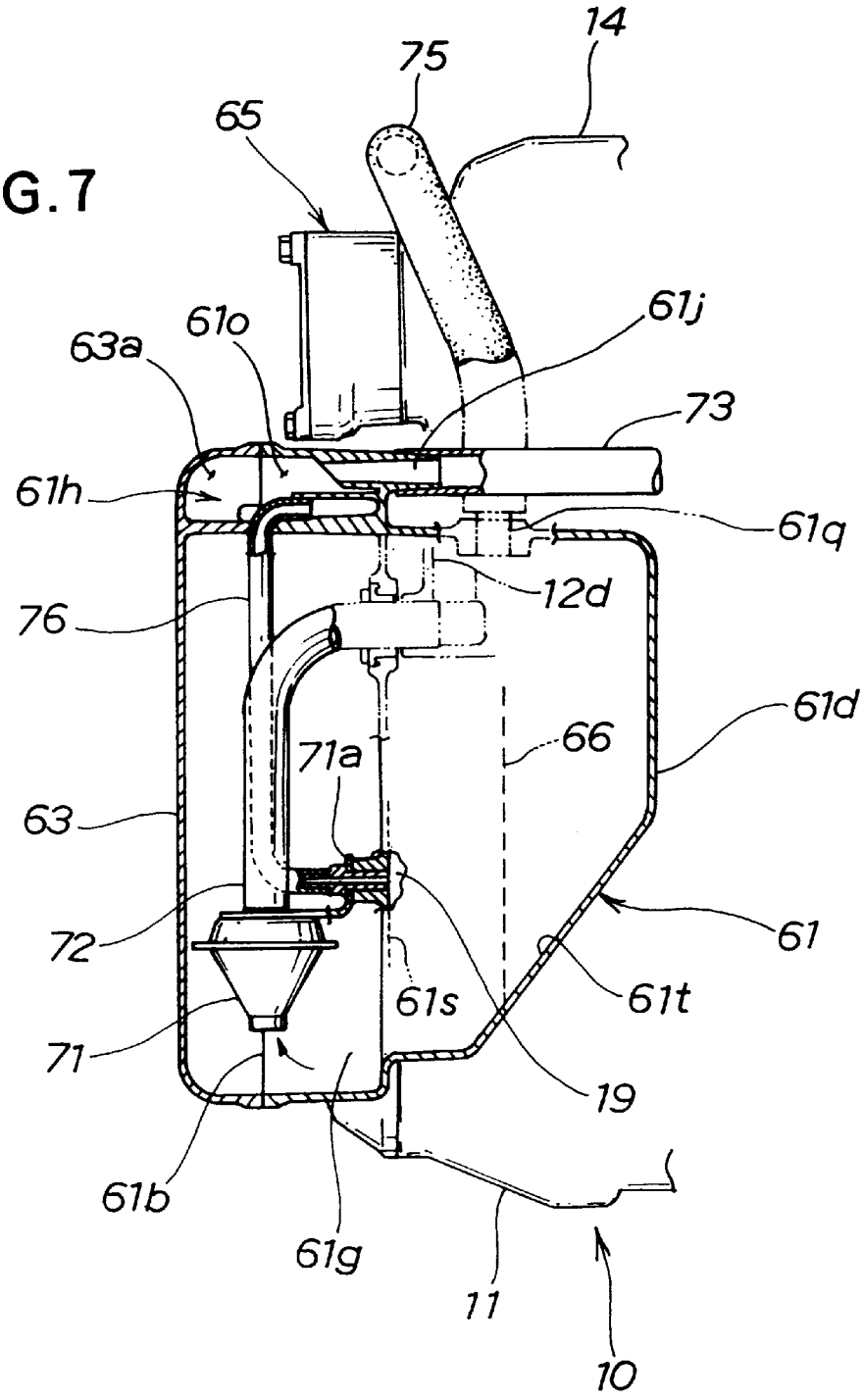
FIG. 7 is a cross-sectional view of the lubricating oil tank.

FIG. 7 is a cross-sectional view of the lubricating oil tank. As shown in this figure, a projecting portion 61*d* of the lubricating oil tank 61 projects forwardly of the engine body 10 along the assembly formed by the cylinder block 12 (see FIG. 3) and the halved crankcase 11. The projecting portion 61*d* is disposed above an intake port of the strainer 71 and includes an inclined bottom portion 61t tapering toward a bottom of the oil accumulating portion 61g. The strainer 71 is supported by the lubricating tank 61 through a supporting stay 71*a*. Within the lubricating oil tank 61, there is disposed an oil returning tube 76. An upper end of the oil returning tube 76 communicates with the second breather chamber 61h while a lower end of the oil returning tube 76 communicates with the crank chamber 19 through an aperture provided in a wall portion 61s of the lubricating oil tank 61. With this arrangement, the oil returning tube 76 serves to return a lubricating oil from the second breather chamber 61h to the crankcase 19. Reference numeral 12*d* designates a wall portion of the cylinder block 12 while reference numeral 73 denotes a first breather tube.

Figure 8:
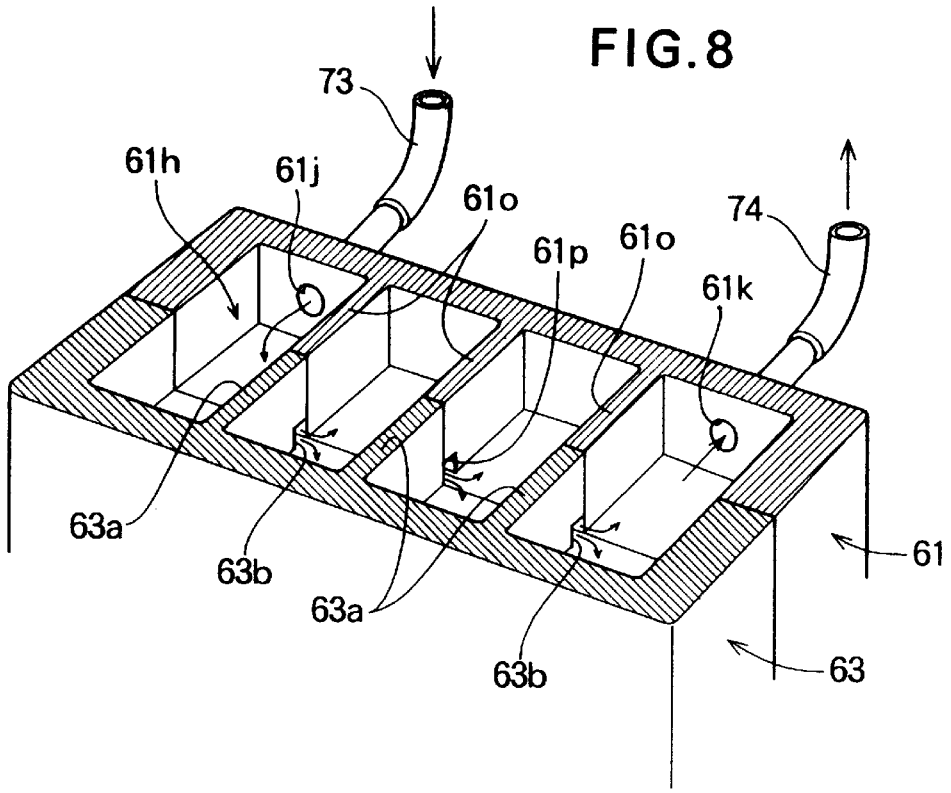
FIG. 8 is a perspective cross-sectional view showing a second breather chamber.

FIG. 8 illustrates the second breather chamber 61h. The second breather chamber 61h is separated into four small chambers with three partition walls 61o abutting against three partition walls 63*a*. Further, provision of a small cut-out portion 61p on the partition wall 61o alternates with provision of a small cut-out portion 63*b* on the partition wall 63*a*, thereby forming a labyrinthine structure.

The second breather chamber 61h includes a gas entrance 61j and a gas exit 61k. The gas entrance 61j communicates with the first breather chamber 18*a* (see FIG. 4) through the first breather tube 73. The gas exit (breather exit) 61k is described below with reference to FIG. 9.

Figure 9:
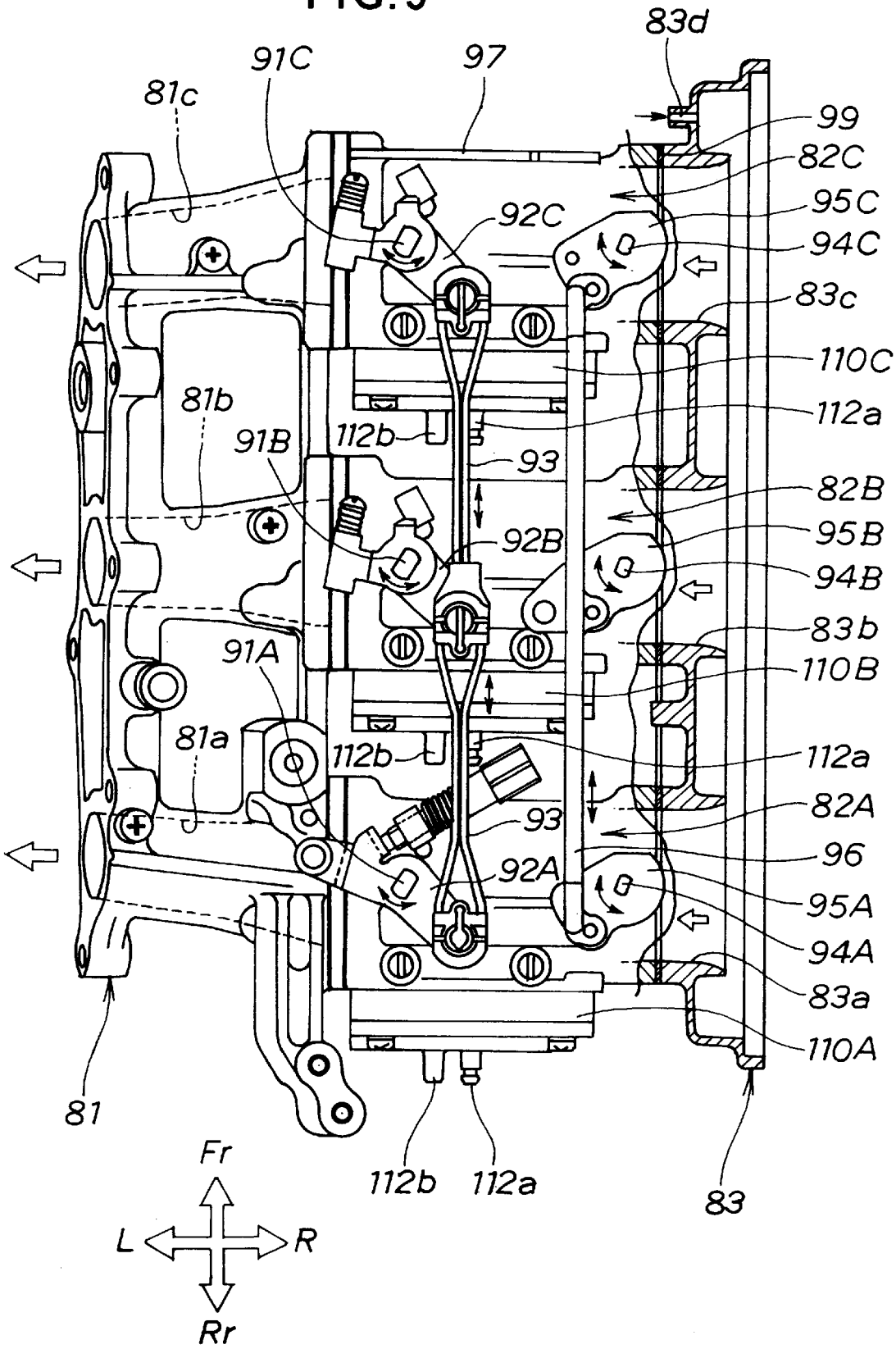
FIG. 9 is a top plan view showing, partially in section, an intake manifold, carburetors, and a communicating tube according to the present invention.

FIG. 9 is a top plan view showing, partially in section, an intake manifold, a communicating tube 83, and a carburetor.

As already described in relation to FIG. 3, the three cylinders 12*a* are juxtaposed In the stern direction Rr.

The intake manifold 81 includes three intake passages 81*a*, 81*b*, 81*c* juxtaposed in the bow direction Fr in correspondence to the three cylinders 12*a* (see FIG. 3). The three diaphragm type carburetors 82A, 82B, 82C are also juxtaposed in the bow direction Fr in correspondence to the respective cylinders 12*a*. The communicating tube 83 includes three communicating apertures 83*a*, 83*b*, 83*c* communicating with the carburetors 82A, 82B, 82C, respectively.

The intake manifold 81, the carburetors 82A, 82B, 82C, and the communicating tube 83 are bolted together. Therefore, an assembly of the carburetors is provided in combination with the three carburetors 82A, 82B, 82C.

The intake passages 81*a*, the carburetor 82A, and the communicating aperture 83*a* communicate with each other. The intake passages 81*b*, the carburetor 82B, and the communicating aperture 83*b* communicate with each other. The intake passages 81*c*, the carburetor 82C, and the communicating aperture 83*c* communicate with each other.

Figure 11:
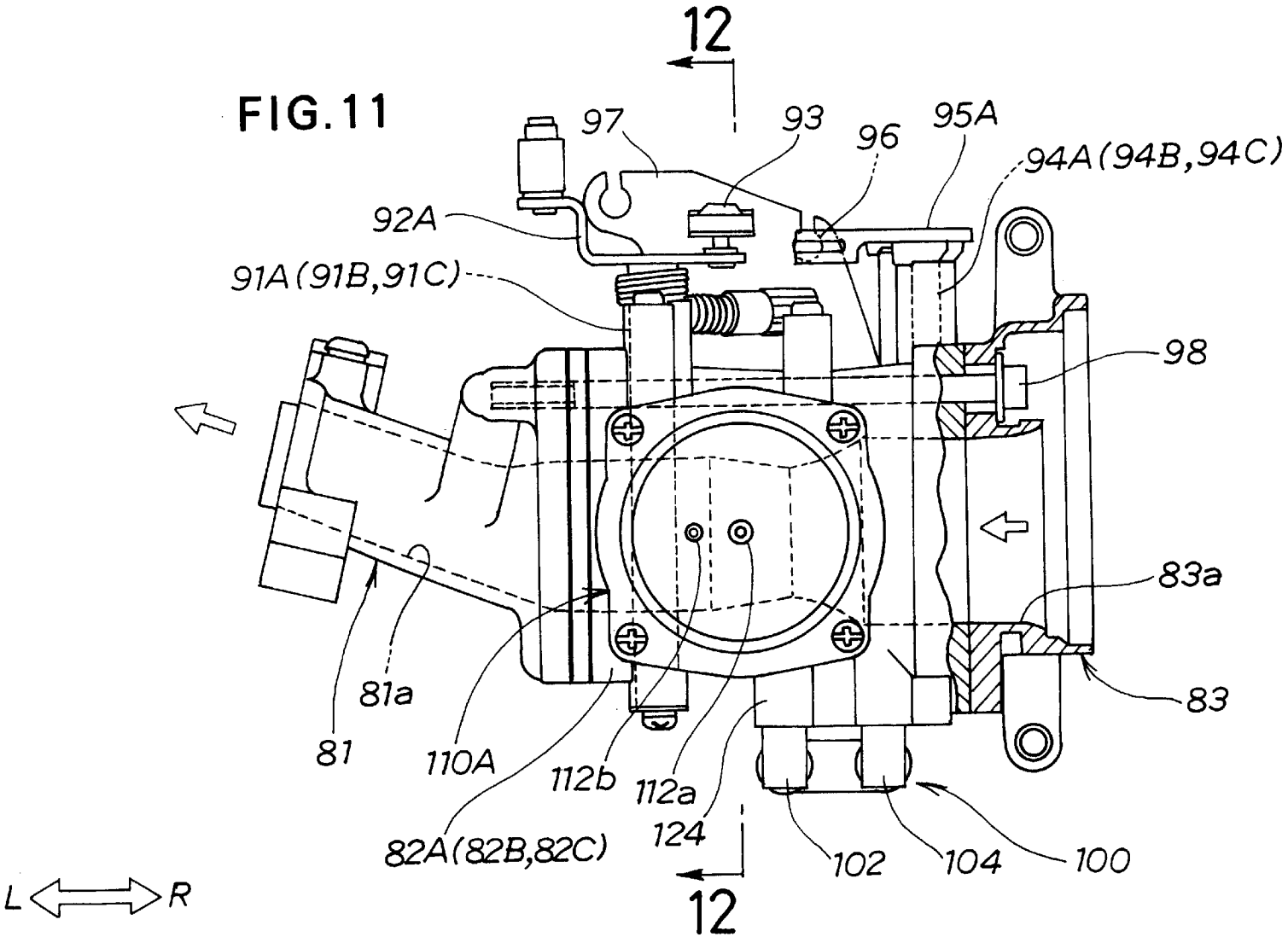
FIG. 11 is a side view showing, partially in section. the intake manifold, the carburetors, and the communicating tube shown in FIG. 9.

Shafts for throttle valves 91A, 91B, 91C are mounted in the carburetors 82A, 82B, 82C, respectively, in vertical extension (see FIG. 11). Upper ends of the shafts 91A, 91B, 91C are connected to two throttle links 93 by means of levers 92A, 92B, 92C each provided thereon.

Moreover, shafts for choke valve 94A, 94B, 94C are mounted in the carburetors 82A, 82B, 82C in vertical extension (see FIG. 11). Upper ends of the shafts 94A, 94B, 94C are connected to a choke link 96 by means of levers 95A, 95B, 95C each provided thereon.

The shafts 91A, 91B, 91C are provided for opening and closing throttle valves (not shown) built in the carburetors 82A, 82S, 82C. The lever 92A is connected to a throttle lever not shown. Thus, by operating the throttle lever, the shafts 91A, 91B, 91C are simultaneously operated by means of the two throttle links 93, 93, thereby controlling the throttle valve.

Likewise, the shafts 94A, 94B, 94C are provided for opening and closing choke valves (not shown) built in the carburetors 82A, 82B, 82C. The lever 95B is connected to a choke lever not shown. Thus, by operating the choke lever, the shafts 94A, 94B, 94C are simultaneously operated by means of the choke link 96, thereby controlling the choke valve.

Further, the carburetors 82A, 82B, 82C include diaphragm mechanisms 110A, 110B, 110C, respectively, perpendicular to the crankshaft axis S (see FIG. 3). Each diaphragm mechanisms 110A, 110B, 110C includes a reference pressure introducing port (reference air intake port) 112*a* and an air escaping port 112*b*. The diaphragm mechanisms 110A, 110B, 110C will be set forth later.

The communicating tube 83 has a gas intake port 83*d*. The gas Intake port 83*d* communicates with the gas exit 61k via the second breather tube 74 as shown in FIG. 8. Reference numeral 97 designates a stay attached to the assembly of the carburetors. Reference numeral 99 denote a packing.

Figure 10:
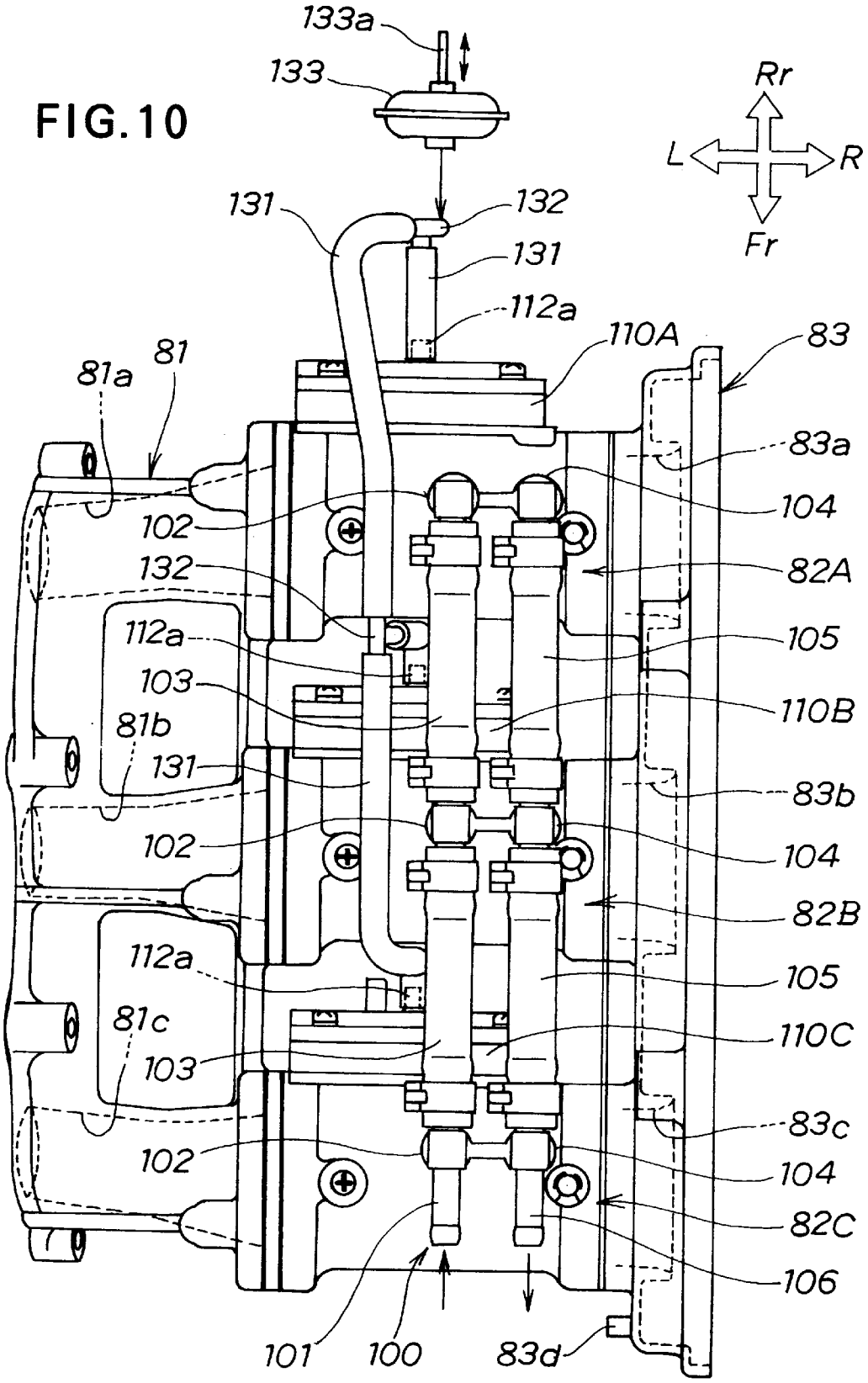
FIG. 10 is a bottom plan view showing the intake manifold, the carburetors, and the communicating tube shown in FIG. 9.

FIG. 10 is a bottom plan view of the intake manifold, the communicating tube, and the carburetor. Below the carburetors 82A, 82B, 82C, there is disposed a fuel supplying pipe 100.

The fuel supplying pipe 100 extends in parallel with the crankshaft axis S, that is, in the direction Rr. More specifically, the fuel supplying pipe 100 includes an introducing pipe 101 for introducing oil from a fuel pump not shown thereinto, three connecting joints 102 and two hoses 103 for introducing oil from the introducing pipe 101 into the individual carburetors 82A, 82B, 82C, three connecting joints 104 and two hoses 105 for returning remaining oil unused in the carburetors to a fuel tank not shown, and a returning pipe 106.

The respective reference pressure introducing ports 112*a* of the diaphragm mechanisms 110A, 110B, 110C face in the direction Rr. The respective reference pressure introducing ports 112*a* communicate with each other by means of three air hoses 131 and two connecting joints 132 each connecting the adjacent air hoses 131 with each other while communicating with a diaphragm type air pump 133 diagrammatically shown in this figure.

A rod 133*a* of the diaphragm type air pump 133 is connected to the lever 92A as shown in FIG. 9 in such a manner as to operate simultaneously with the lever 92A. Therefore, by quick operation of the throttle lever not shown, air pressure is quickly applied to the diaphragm mechanisms 110A, 110B, 110C, thereby varying pressures exerted against the diaphragm mechanisms 110A, 110B, 110C. The diaphragm type air pump 133 serves as a damper for the diaphragm mechanisms upon rapid operation of the throttle lever.

FIG. 11 is a side view showing, partially in section, the intake manifold, the communicating tube, and the carburetor. The intake manifold 81, the carburetors 82A, 82B, 82C, and the communicating tube 83 are connected together by means of a bolt 98. The shafts 91A, 91B, 91C extend vertically. Similarly, the shafts 94A, 94B, 94C extend vertically.

Figure 12:
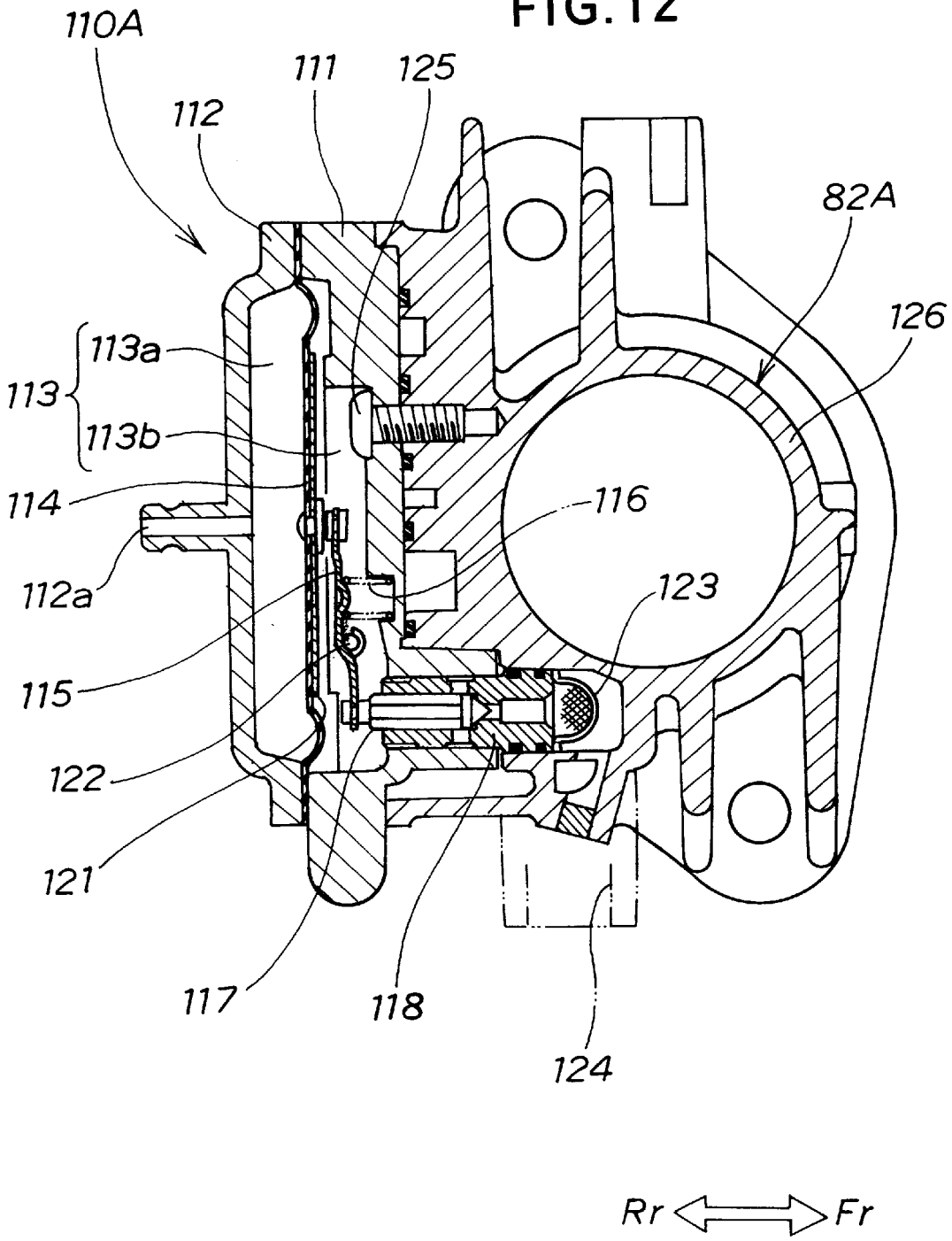
FIG. 12 is a cross-sectional view taken along line 12—12 of FIG. 11.

FIG. 12 is a cross-sectional view taken along line 12—12 of FIG. 11, showing, in section, the diaphragm mechanism 110A attached to the carburetor 82A.

The diaphragm mechanism 110A includes a case body 111, a lid 112, a diaphragm chamber 113 jointly formed by the case body 111 and the lid 112, a diaphragm 114 separating the diaphragm chamber 113 into a reference pressure chamber 113*a* and an applying pressure chamber 113*b*. a swing arm 115 pivotably mounted in the applying pressure chamber 113*b* with one end thereof located centrally of the diaphragm 114, a compression spring 116 for urging the one end of the swing arm 115 toward the diaphragm 114, a valve body 117 for attaching the other end of the swing arm 115 thereto, and a valve seat 118 opened and closed by the valve body 117. The applying pressure chamber 113*b* communicates with an interior portion 127 of the carburetor 82A.

The diaphragm type carburetor 82A with the diaphragm mechanism 110A is a carburetor free from a float in which the diaphragm 114 controls the valve body 117 for introducing oil into the carburetor 82A.

The crankshaft axis S (see FIG. 3) extends in the direction Fr-and-Rr while an operating surface of the diaphragm 114 faces in the direction Rr. Therefore, the diaphragm 114 moves in the same direction as the crankshaft axis S extends in.

The reference pressure introducing port 112*a* and the air escaping port 112*b* (see FIG. 11) communicate with the reference pressure chamber 113*a*. The diaphragm 114 includes an auxiliary plate 121 for assisting the operating surface of the diaphragm 114 in moving in the stern direction Rr. The swing arm 115 is supported by a swing arm supporting shaft 122 provided below the compression spring 116. The case body 111 of the diaphragm mechanism 110A is attached to a body 126 of the carburetor 82A by a bolt 125. Reference numeral 123 and 124 designate a strainer and an oil introducing port.

Next, an operation of the diaphragm mechanism 110A will be described below in relation to FIG. 10 and FIG. 12.

Referring to FIG. 12, a pressure in the reference pressure chamber 113*a* is usually an atmospheric pressure.

In such a condition, when a pressure in the interior portion 127 becomes smaller than that in the reference pressure chamber 113*a*, an oil is supplied from the oil introducing port 124. Then, the oil of which amount corresponds to the pressure in the interior portion 127 is sprayed out of an oil spraying nozzle (not shown) into the interior portion 127 after flowing through the strainer 123, the valve seat 118 and the applying pressure chamber 113*b*. The valve body 117 determines an amount of oil introduced into the applying pressure chamber 113*b* on the basis of difference in oil pressure between the applying pressure chamber 113*b* and a side of strainer 123.

While the throttle lever is quickly operated to apply an air pressure from the diaphragm type air pump 133 shown in FIG. 10 to the reference pressure chamber 113*a*, the pressure in the reference pressure chamber 113*a* is increased. Consequently, oil supplied to the carburetor 82A in increased in amount.

Since the diaphragm mechanisms 110B and 110C are the same in arrangement and operation as the diaphragm mechanism 110A, their explanation will be omitted.

As described in FIG. 9, there is formed the assembly in combination with the three carburetors 82A, 82B, 82C, whereby an overall size of the carburetors is made small. Therefore, the pitches between the cylinders 12*a*, 12*a* of the engine unit 3 can be generally equal to those between the carburetors 82A, 82B, 82C. With this arrangement, the respective intake passages 81*a*, 81*b*, 81*c* can have generally the same configuration. Since the intake passages 81*a*, 81*b*, 81*c* have generally the same configuration, an amount of air taken into each cylinder 12*a*, 12*a*, 12*a* can be uniform, thereby making output characteristics of the engine unit 3 constant.

In the preferred embodiment of the present invention, the cylinders of the engine unit 3 are not limited in number. For example, four cylinders may be employed. The diaphragm type carburetors are equal in number to the cylinders of the engine unit 3.

Obviously, various minor changes and modifications of the present invention are possible in the light of the above teaching. It is therefore to be understood that within the scope of the appended claims, the present invention may be practiced otherwise than as specifically described.

What is claimed is:

1. A small-sized boat thrust by a jet pump and having a hull for containing an engine for driving the jet pump, the engine comprising: a multicylinder four-stroke engine disposed in an engine compartment of the hull for driving the jet pump, the multicylinder engine having a crankshaft extending along a line passing through a bow and a stern of the hull; a plurality of diaphragm carburetors each without a float and each including a shaft for a throttle valve provided vertically with respect to the crankshaft of the engine, the number of diaphragm carburetors corresponding to the number of respective cylinders of the engine, one throttle link connected to upper parts of each of the shafts for the throttle valves, and each carburetor having a diaphragm mechanism having an operating surface disposed perpendicular to the crankshaft axis; an air pump connected to an input of each of the diaphragm carburetors and to the throttle link for regulating an air supply to the carburetors; and a fuel supplying pipe disposed below the carburetors in parallel with the crankshaft axis.

2. A small-sized boat according to claim 1; wherein the plurality of carburetors are assembled together to form a single body.

3. A small-sized boat according to claim 1; wherein a pitch between the plurality of carburetors is substantially equal to a pitch between the cylinders of the engine, and respective intake passages of an intake manifold connected to the engine are substantially the same in configuration.

4. A small-sized boat according to claim 1; wherein each of the carburetors further comprises a shaft for a choke valve provided vertically, and a single choke link connected to upper parts of the shafts for the choke valves by means of levers each provided on the shaft for the choke valve.

5. A small-sized boat according to claim 1; wherein the diaphragm mechanism comprises a case body, a lid, a diaphragm chamber formed by the case body and the lid, a diaphragm for separating the diaphragm chamber into a reference pressure chamber and a pressure applying chamber, a swing arm pivotably mounted in the pressure applying chamber with one end thereof located centrally of the diaphragm, a compression spring for urging the one end of the swing arm toward the diaphragm, a valve body for attaching the other end of the swing arm thereto, and a valve seat opened and closed by the valve body.

6. A small-sized boat according to claim 1; wherein the boat has a single seat for straddling by one or more passengers, the seat being disposed along a central axis of the hull directly above the engine compartment.

7. A small-sized boat according to claim 1; wherein the multicylinder four stroke engine is a dry sump lubricating engine having the plurality of cylinders arranged in-line along a center line of the hull passing through the bow and the stern thereof, and comprises an engine body, a valve actuating driving mechanism attached to a front portion of the engine body facing the bow for driving a camshaft of a valve actuating mechanism by means of a belt driven by a crankshaft, a flywheel unit attached to a front portion of the engine body, and a lubricating unit attached to a rear portion of the engine body facing the stern.

8. A small-sized boat according to claim 7; wherein the engine body comprises a crankcase, a cylinder block including the plurality of cylinders arranged along the center line of the hull, a cylinder head, a head cover for covering the cylinder head, a crankshaft disposed in the crankcase, a piston slidably engaged in each cylinder and connected to the crankshaft, a power take-off shaft connected to a rear end of the crankshaft for driving the jet pump, a valve actuating chamber jointly defined by the cylinder head and the head cover, and a valve actuating mechanism accommodated within the valve actuating chamber.

9. A small-sized boat according to claim 6; wherein the power take-off shaft extends rearwardly of the lubricating unit for connection to a drive shaft of the jet pump and has a first connecting portion connected to the crankshaft and a second connecting portion for connecting to the drive shaft of the jet pump drive to output motive power from the engine to drive the jet pump.

10. A small-sized boat according to claim 8; wherein the valve actuating driving mechanism comprises a driving pulley secured to and protruding from a front portion of the crankcase, a driven pulley secured to the camshaft protruding from a front part of the cylinder head, a timing belt passing over the driving and driven pulleys, a belt tensioner for adjusting tension of the timing belt, and a belt cover for covering the belt.

11. A small-sized boat according to claim 10; wherein the flywheel unit includes a flywheel bolted to a front end of the crankshaft, a wheel case bolted to a front side portion of an assembly formed by assembling the cylinder block and the crankcase together to accommodate the flywheel therein, and a sheet-shaped lid bolted to a free end of the wheel case to cover the wheel case.

12. A small-sized boat according to claim 11; further comprising a generator comprising a rotor attached to an interior peripheral surface of the flywheel, and a coil mounted on the wheel case.

13. A small-sized boat according to claim 8; further comprising a blow-by gas returning first breather chamber disposed at an upper part of the head cover positioned at an upper part of the valve actuating chamber.

14. A small-sized boat according to claim 13; further comprising an induction box for connecting to the carburetors by means of a communicating tube so that there is formed an intake line for the engine body comprised of the intake manifold, the carburetors and the induction box.

15. A small-sized boat according to claim 14; wherein the induction box has an intake port disposed at a lower portion thereof.

16. A small-sized boat according to claim 14; wherein the intake manifold includes an intake passage for each of the cylinders juxtaposed in the bow direction, the diaphragm type carburetors are juxtaposed in the bow direction corresponding to the respective cylinders, and the communicating tube includes communicating apertures for communicating with respective carburetors.

17. A small-sized boat according to claim 16; wherein each respective intake passage communicates with a respective carburetor and a respective communicating aperture.

18. A small-sized boat according to claim 6; wherein the lubricating unit includes a lubricating oil tank disposed outside the crankcase for supplying lubricating oil to lubrication points of the engine and a bottom portion of the crankcase below the crankshaft through which unused lubricating oil is temporarily collected to be pumped up into the lubricating oil tank.

19. A small-sized boat according to claim 8; wherein the crankcase includes at least one oil collecting portion for each cylinder for collecting lubricating oil which remains after lubrication of sliding parts of the engine, a guiding passage for guiding the lubricating oil collected in the oil collecting portions, and a returning oil passage for returning the lubricating oil from the guiding passage to the lubricating unit.

20. A small-sized boat according to claim 19; wherein each of the oil collecting portions comprises an oil reservoir having a small capacity disposed closely to the crankshaft such that the lubricating oil accumulated therein is not in contact with a counterweight of the crankshaft.

21. A small-sized boat according to claim 20; wherein each of the oil collecting portions has a baffle plate for separating the crankshaft and a surface of the lubricating oil positioned below the crankcase.

22. A small-sized boat according to claim 21; wherein each baffle plate is fixed to the crankcase and positioned below the crankshaft and is secured to the crankcase by engaging one point thereof with an engaging projection lid formed at a bottom portion of the crankcase and bolting another point thereof to the crankcase.

23. A small-sized boat according to claim 19; wherein the lubricating unit comprises a lubricating oil tank bolted to a rear side portion of the assembly formed by the cylinder block and the crankcase, a lid for closing a rear end of the lubricating oil tank, a returning pump for returning a lubricating oil from the oil collecting portions to the lubricating oil tank, and a supplying pump for supplying a lubricating oil from the lubricating oil tank to sliding parts of the engine.

24. A small-sized boat according to claim 23; wherein the returning pump is disclosed in the lubricating oil tank.

25. A small-sized boat according to claim 23; wherein the supplying pump is disposed separately from the lubricating oil tank.

26. A small-sized boat according to claim 23; wherein a tank mounting packing surface is formed on a side of the assembly formed by the cylinder block and the crankcase for mounting the lubricating oil tank to the crankcase, the packing surface being formed on a surface perpendicular to the crankshaft.

27. A small-sized boat according to claim 23; wherein the returning pump comprises a scavenging pump comprising a case portion formed integrally with the lubricating oil tank, an inner cover for closing the case portion, an inner rotor accommodated within the case portion, an outer rotor disposed on an outer peripheral portion of the inner rotor, and a shaft connected to the crankshaft through a driving mechanism so as to drive the inner and outer rotors.

28. A small-sized boat according to claim 18; wherein the driving mechanism is accommodated in a space defined between the lubricating oil tank and the assembly formed by the cylinder block and the crankcase.

29. A small-sized boat according to claim 28; wherein the space serves as one part of a breather passage for communicating the valve actuating chamber and a crank chamber of the crankcase with each other.

30. A small-sized boat according to claim 23; further comprising an oil passage for the returning pump formed in a joining surface between the lubricating oil tank and the lid, an intake oil passage and a discharging oil passage for the returning pump formed in the lubricating oil tank, and an intake oil passage and a discharging oil passage for the returning pump formed in the lid, the intake oil passage formed in the lubricating oil tank communicating with a returning oil passage formed in the crankcase.

31. A small-sized boat according to claim 30; wherein the intake oil passages communicate with each other to define one intake oil passageway, and the discharging oil passages communicate with each other to define one discharging oil passageway.

32. A small-sized boat according to claim 23; wherein the supplying pump includes a case body bolted to a side portion of an assembly formed by assembling together the cylinder head and the head cover, a cover for closing the case body, an inner rotor accommodated within the case body, an outer rotor positioned on an outer peripheral portion of the inner rotor, and a shaft directly connected to the camshaft of the valve actuating mechanism so as to drive the inner and outer rotors.

33. A small-sized boat according to claim 23; wherein the assembly formed by the cylinder block and the cylinder head includes an intake oil passage and a discharge oil passage for the supplying pump.

34. A personal watercraft comprising: a hull; an engine compartment defined by the hull; a single seat for straddling by one or more passengers disposed along a central axis of the hull directly above the engine compartment; a jet pump for producing forward thrust by expelling water from a stern of the watercraft to propel the watercraft in a forward direction; and an engine disposed in the engine compartment for driving the jet pump, the engine comprising a multicylinder engine having a crankshaft extending along a line passing through the bow and stern of the hull, a plurality of diaphragm carburetors each without a float and each including a shaft for a throttle valve provided vertically with respect to the crankshaft of the engine, the number of diaphragm carburetors corresponding to the number of cylinders of the engine, one throttle link connected to upper parts of each of the shafts for the throttle valves, and each carburetor having a diaphragm mechanism having an operating surface disposed perpendicular to the crankshaft axis and a fuel supplying pipe disposed below the carburetors in parallel with the crankshaft axis.

35. A personal watercraft according to claim 34; further comprising an air pump connected to an input of each of the diaphragm carburetors and to the throttle link for regulating an air supply to the carburetors.

36. A personal watercraft according to claim 34; wherein the plurality of carburetors are assembled together to form a single body.

37. A personal watercraft according to claim 34; wherein a spacing between the plurality of carburetors is substantially equal to a spacing between the cylinders of the engine, and respective intake passages of an intake manifold connected to the engine are substantially the same in configuration.

38. A personal watercraft according to claim 34; wherein each of the carburetors further comprises a shaft for a choke valve provided vertically, and a single choke link connected to upper parts of the shafts for the choke valves by means of levers each provided on the shaft for the choke valve.

39. A personal watercraft according to claim 34; wherein each diaphragm mechanism comprises a case body, a lid, a diaphragm chamber formed by the case body and the lid, a diaphragm for separating the diaphragm chamber into a reference pressure chamber and a pressure applying chamber, a swing arm pivotably mounted in the pressure applying chamber with one end thereof located centrally of the diaphragm, a compression spring for urging the one end of the swing arm toward the diaphragm, a valve body for attaching the other end of the swing arm thereto, and a valve seat opened and closed by the valve body.

* * * * *